United States Patent [19]

Thomas et al.

[11] Patent Number: 4,650,369

[45] Date of Patent: Mar. 17, 1987

[54] CULVERT STRUCTURE

[75] Inventors: David C. Thomas, Moraga, Calif.; John W. Alcorn, Dunwoody, Ga.; William T. Nearn, II, Sacramento, Calif.

[73] Assignee: Kaiser Aluminum & Chemical Corporation, Oakland, Calif.

[21] Appl. No.: 802,281

[22] Filed: Nov. 27, 1985

[51] Int. Cl.[4] ..... E01F 5/00

[52] U.S. Cl. ..... 405/126; 405/150

[58] Field of Search ..... 405/124–126, 405/134, 135, 150, 151, 153, 288; 29/429, 469, 526, 155 R; 138/134, 154, 155, 105, 106, 172, 173

[56] References Cited

U.S. PATENT DOCUMENTS

| | | | |
|---|---|---|---|
| 800,953 | 10/1905 | Sperry | 405/125 |
| 832,017 | 9/1906 | Hummel | 405/126 |
| 1,040,442 | 10/1912 | Shannon | 138/173 X |
| 1,263,340 | 4/1918 | Silk | 138/154 |
| 1,713,881 | 5/1929 | Seifert | 138/155 X |
| 1,999,500 | 4/1935 | Carswell et al. | 405/124 |
| 3,487,537 | 1/1970 | Lombardi | 29/429 X |
| 3,508,406 | 4/1970 | Fisher | 405/124 |
| 4,141,666 | 2/1979 | De Graff | 405/126 |
| 4,161,194 | 7/1979 | Nyssen | 138/173 X |
| 4,318,635 | 3/1982 | Gurtner et al. | 405/126 |

*Primary Examiner*—Cornelius J. Husar
*Assistant Examiner*—Nancy J. Stodola
*Attorney, Agent, or Firm*—Andrew E. Barley

[57] ABSTRACT

A low headroom culvert is provided wherein a series of shallow arch-shaped flat metallic sections are overlappingly secured together. Torsion and buckle resistant reinforcing cross ribbing elements are affixed to the exterior culvert sections at selected points along the culvert to form girder-like beams. The improved culvert structure provides reduced hydraulic flow resistance, can be easily installed and requires less metal for its manufacture in comparison to culverts made of corrugated sheet.

10 Claims, 5 Drawing Figures

FIG._4.
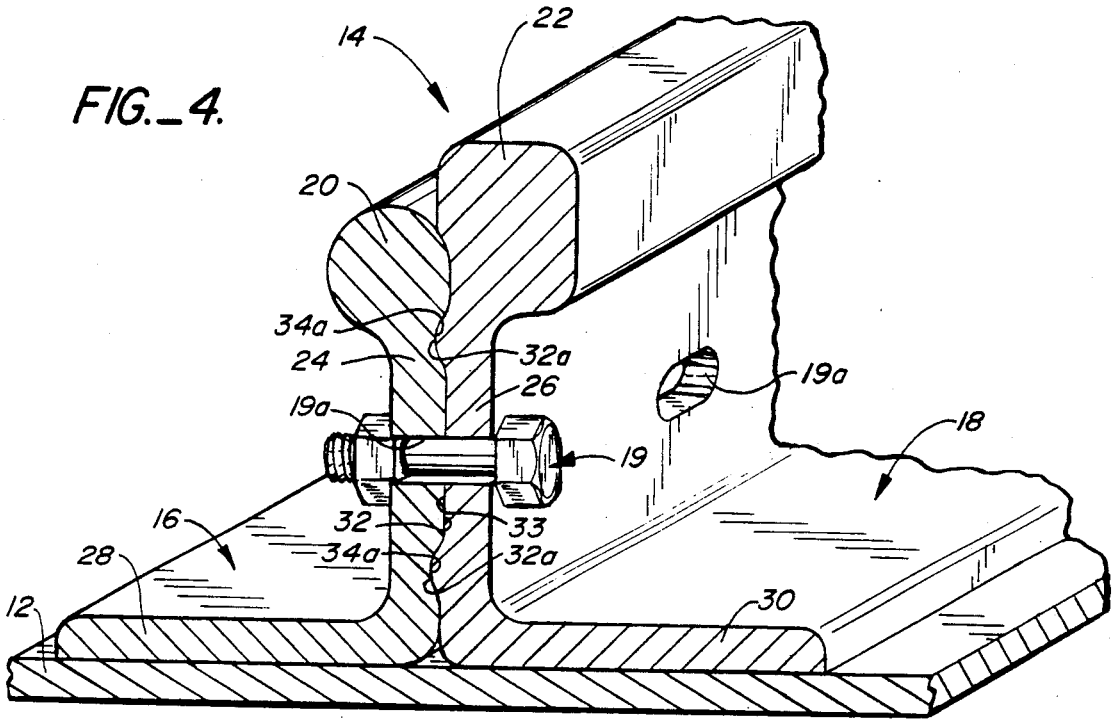
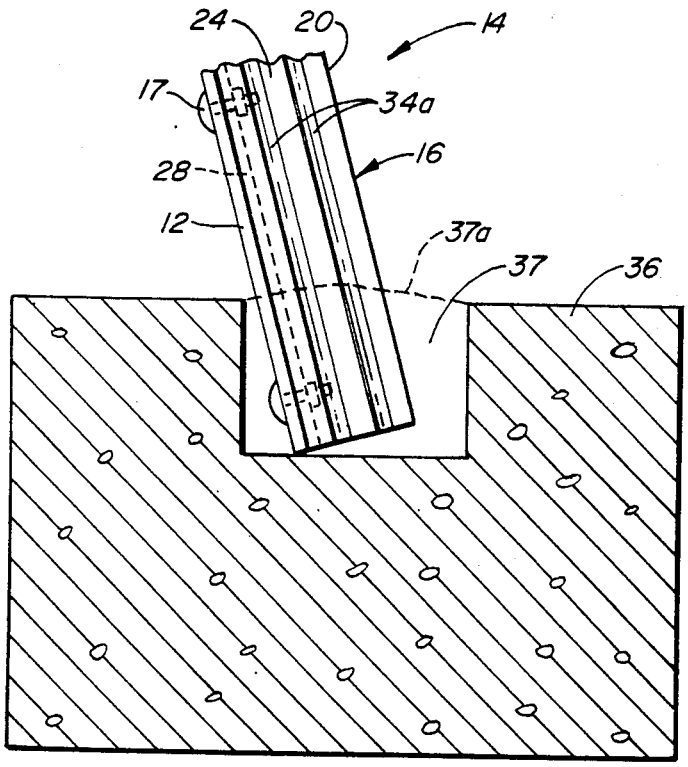
FIG._5.

CULVERT STRUCTURE

BACKGROUND OF INVENTION

The present invention relates to culvert structures and more particularly to low headroom culvert structures fabricated from shallow arch shaped flat or non-corrugated sections and girder-like beams made up of upstanding reinforcing rib elements disposed on the outside of the culvert. The instant invention is especially useful in the construction of hydraulic culverts. A "hydraulic culvert" as used in the instant specification and claims is intended to mean a drain structure used primarily to carry off high volumes and high velocity flows of water or the like caused by runoff, flooding, cloudbursts, etc.

In the past shallow arch low headroom culverts were normally fabricated from heavy guage metal sections and they sometimes required reinforcing concrete sections and/or reinforcing metal ribs. In other instances they were made from specially configured matching metal plate elements secured together by various complex fixtures and/or fasteners. Examples of such prior art culvert sections are to be found in U.S. Pat. Nos. 538,432; 587,392; 625,795; 800,953; 832,017; 905,290; 950,928; 1,013,440; 1,040,442; 1,926,843; 1,935,273; 1,999,500; 2,343,029; 4,141,666; 4,318,635; and 4,459,063 as well as the culvert structures described and discussed in various copyrighted brochures of Kaiser Aluminum & Chemical Corporation or Kaiser Aluminum & Chemical Sales, Inc., such as "Aluminum Box Culvert" Copyrighted in 1983, "Aluminum Structural Plate" Copyrighted in 1974 and 1985, "Aluminum Storm Sewers" Copyrighted in 1976, and "Aluminum Storm Water Control" Copyrighted in 1983. Other approaches to improving hydraulic capacity and flow are represented by the smooth walled metal spiral culverts of U.S. Pat. Nos. 4,161,811; 4,161,194; and 3,487,537.

The culverts of U.S. Pat. No. 4,141,666 and the aforesaid brochure entitled "Aluminum Box Culvert" are of particular interest. The low headroom culverts of these references were built from corrugated metal sheet or plate in order to meet the stringent and rigid strength requirements of the regulatory bodies and standard setting commissions of the various states and/or counties in the states. Corrugated sheet and plate sections, however, have various disadvantages. For example, they pose problems in corrugation matching at the joints because of the manufacturing pitch and depth tolerances of the matching corrugations. This results not only in an increase in installation time and effort but in fabrication costs because of the need to develop special tools to treat the end portions of the corrugations so they will mate and properly interfit. Corrugated sections also require more metal than flattened sections to cover the same surface areas and this increase in metal costs is passed on to the customer user. Last but not least corrugated culvert sections are not always truly efficient in carrying off water because of the inherent surface roughness of the sections due to the corrugations. This in turn means that for a given cross-sectional area of corrugated culvert the total volume of fluid, e.g., water, carried by the culvert in a given time period will be much less than in the case where the walls of the culvert are smooth. In short the corrugations retard water flow and the deeper the corrugations the more restricted the flow.

The net result is that such prior art corrugated metal wall culverts were not always the most efficient drainage mediums particularly in the case of hydraulic culverts designed particularly to carry high volumes of water and high velocity water runoff. By avoiding the use of corrugated sections and internal strengthening elements that project into the culvert the non-corrugated culvert of the instant invention by virtue of its novel construction can still retain satisfactory drainage characteristics while using less material, etc. The instant culvert structure relies substantially entirely on the girder-like arched cross beams provided by improved cross ribbing elements as the primary load bearing members in the culvert. The relatively high bending moment continuity of each beam is maintained from one side edge of the culvert to the other by virtue of the improved construction of the beams and their attachment to the metal sheeting. Further advantageous features of the instant invention will be observed by reference to the following detailed description when taken in conjunction with the appending drawings.

SUMMARY OF INVENTION

The instant invention is concerned with a low headroom or shallow arch box culvert wherein a series of shallow arch shaped flat or non-corrugated metallic sections are overlappingly secured together so as to present a relatively obstruction free walled interior and conduit for fluids passing therethrough. Improved torsion and buckle resistant reinforcing cross ribbing elements are affixed to the exterior surfaces of the metallic culvert sections at selected points along the culvert including the points of overlap of the sections. These cross ribbing elements serve as torsion and buckle resistant arched girder-like beams and they make up the main framework for the culvert from which the metallic sheeting sections are then dependingly attached to form a unitized structure. The terminal ends of these girder-like beams are preferably anchored to and in appropriate footings and since these same beams have relatively high bending moments they advantageously provide the desired high bending moment continuity at selected points across the width of the culvert. The lapped and overlapped portions of the metallic culvert sections are advantageously connected to each other in the areas where the metallic sections are also dependingly attached to the girder-like beams. In this way the lapped and overlapped sections can simultaneously be directly connected to the beams and enhance and not detract from the efficiency of the beams in carrying the culvert loads transferred thereto by the metallic sheeting.

BRIEF DESCRIPTION OF THE DRAWINGS

FIG. 4 is an enlarged fragmentary perspective view of cooperating spliced haunch and crown ribs provided with interlocking tongue and groove portions; and FIG. 5 is an end elevational view of one type of concrete footing that can be used to anchor the terminal end portions of the girder-like arched cross beams and in turn the culvert to the earth at the installation site when taken within the circumscribing circle 5 of FIG. 1.

DETAILED DESCRIPTION

Figure 1:
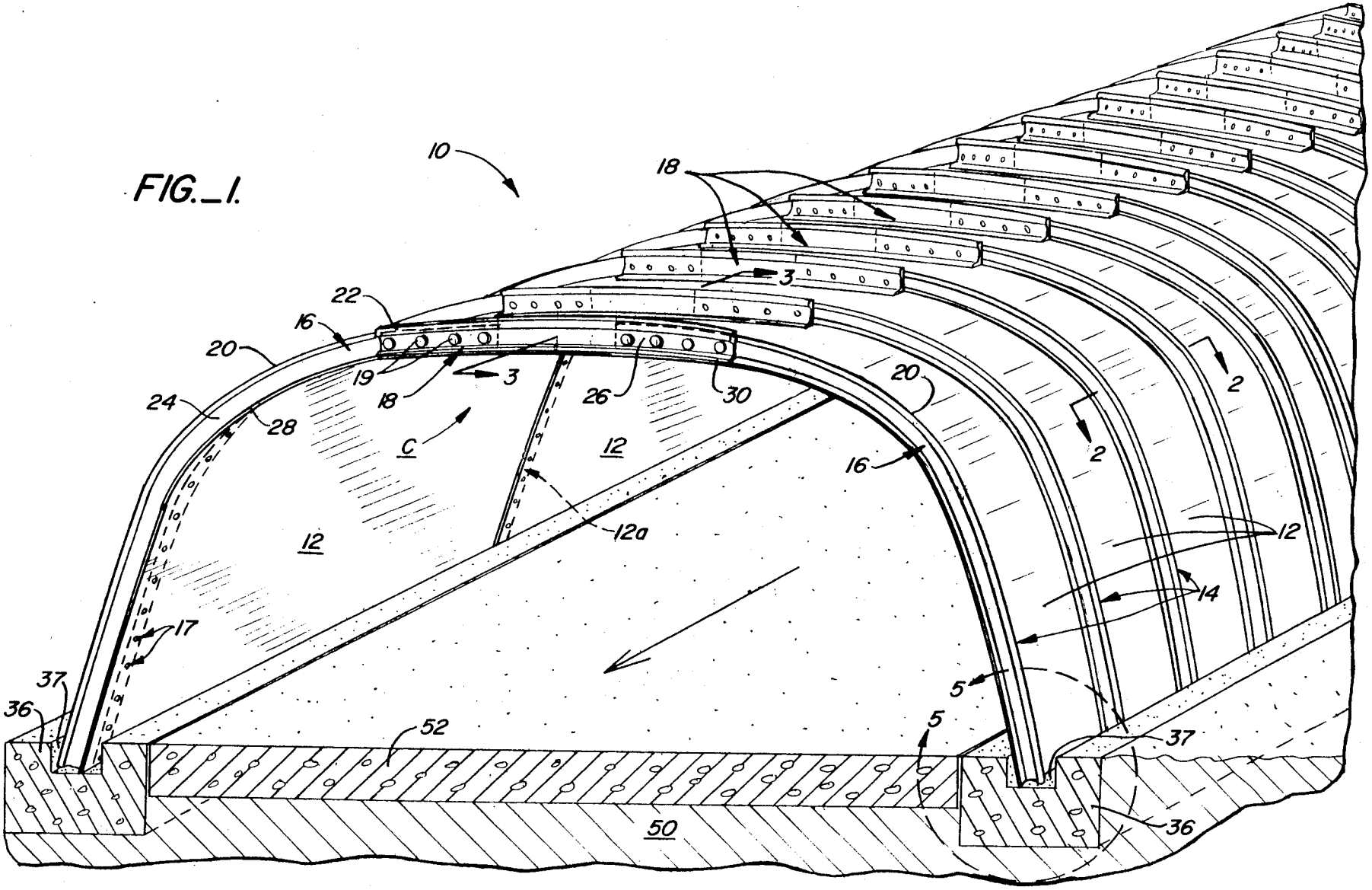
FIG. 1 is a fragmentary perspective view of a shallow arch box culvert constructed in accordance with the teachings of the instant invention with the direction of water flow shown and with certain details being omitted for the sake of clarity.
Figure 2:
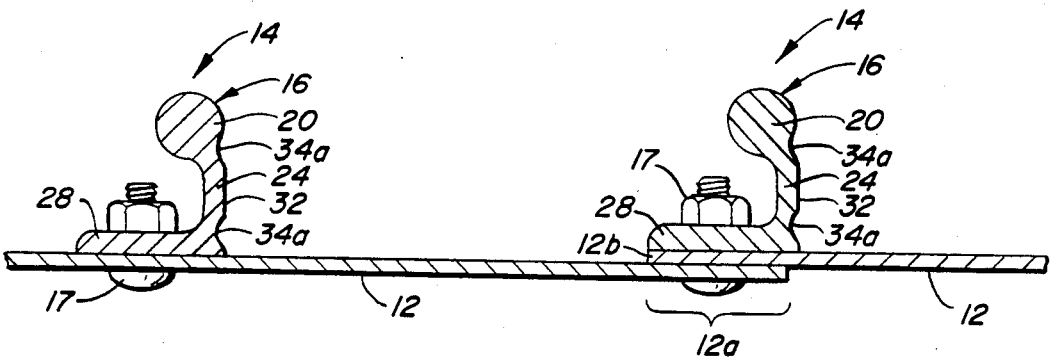
FIG. 2 is a cross-sectional view of the culvert of FIG. 1 when taken generally along line 2—2 thereof.
Figure 3:
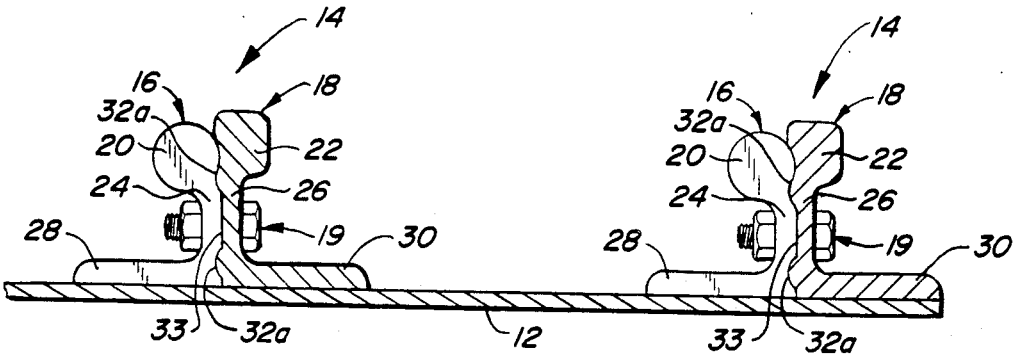
FIG. 3 is another cross-sectional view of the culvert of FIG. 1 when taken generally along line 3—3 thereof; and shows in some detail how given pairs of haunch ribs forming a major part of a girder-like beam are spliced to crown ribs.

With further reference to the drawings and particularly FIGS. 1-3 the improved shallow arch or low headroom box culvert structure 10 in a preferred embodiment of the invention is generally comprised of a plurality of preformed shallow arch shaped and smooth walled metal sections 12 of selected length, width and curvature depending on the size of a given culvert. The marginal side edge portions of sections 12 are overlapping secured together as well as to the girder-like beams 14 in the typical joint structure indicated in FIG. 2. Although each beam 14 can be fabricated as a single appropriately curved member it is preferably made for ease of manufacture from a pair of side or haunch ribs 16 spliced together at the crown segment or area C of the culvert by means of a crown rib 18. Crown and haunch ribs are spliced or joined to each other by means of the bolt fastener and nut assemblies 19 after the bolts in such assemblies are thrust through the aligned openings 19*a* located in the central portion of the upstanding walls 24 and 26 respectively of the haunch and crown ribs 16 and 18. If desired these openings can also take the form of somewhat elongated slots for bolt adjustment purposes as indicated for example in FIG. 4. The upstanding wall 24 of a haunch rib 16 terminates at the top in a bulbous reinforcing head portion 20 and at the bottom in a base flange 28. The wall 26 of a crown rib 18 is likewise terminated at the top by way of a bulbous or enlarged head 22 and at the bottom by way of a base flange 30. The bottom base flanges of the various haunch and crown rib beam segments are secured directly to the outside surfaces of the culvert sections 12 by appropriate nut and bolt assemblies 17. Although these assemblies 17 are shown as being used only with the haunch rib base flanges in FIG. 2, they can also be used with the crown rib base flanges. As further indicated in FIG. 2, certain of the beams formed by a pair of haunch ribs and crown ribs 16 and 18 respectively are advantageously secured to the culvert sections 12 at the points of overlap of these sections whereby the loads imposed on the metallic sheet sections 12 can then be transferred directly to the beams 14 and the integrity of the beams 14 as the primary load carrying members maintained. It is to be noted of course that the degree of curvature of the various haunch and crown ribs 16 and 18 will depend on the degree of curvature of the particular culvert arch in which they are to be incorporated.

A preferred embodiment of the invention contemplates that metallic sheet sections 12 be made from a strong lightweight corrosion resistant aluminum alloy such as 5052-H141 aluminum sheet as designated by The Aluminum Association and of 0.125" (0.3175 cm) gauge while the haunch and crown ribs 16 and 18 can be extruded from another corrosion resistant aluminum alloy such as a 6061-T6 alloy as designated by The Aluminum Association. Although aluminum is the preferred material for the culvert sections 12 and the beams 14, sections 12 and beam components 16 and 18 can be fabricated from other materials such as appropriate grades of galvanized steel in which case the haunch and crown ribs 16 and 18 then would be usually so fabricated as to be provided with the upstanding wall and base flanges, aforedescribed plus the tongue and groove features to be described.

In a further advantageous embodiment of the invention the haunch and crown ribs 16 and 18 regardless of the materials used to fabricate the same are so shaped as to be fitted with interlocking tongue and groove means at least in the areas where they are to be spliced and mated so as to augment and enhance the normal buckle resistant and anti-torsion characteristics of the final arch shaped beams 14. Accordingly in the case of the extruded haunch and crown ribs 16 and 18 disclosed in FIGS. 3 and 4 the haunch rib wall 24 can have at least one elongated tongue 32 which fits in the elongated recess or groove 33 of wall 26 of the crown rib 18 while the crown rib 18 can have one or more elongated tongues 32*a* which fit within one or more elongated recesses 34*a* in the wall 24 of each of the two haunch ribs 16 being spliced together by the crown rib 18.

When the ribs 16 and 18 are fabricated in the form of aluminum extrusions the tongue and groove features can be readily incorporated therein during the extruding operation and they can run the full length of the extrusions in question. These tongue and groove features, moveover, can take various forms in order to provide a strong sinuous joint structure between ribs 16 and 18. From the above it will be observed that utilization of the tongue and groove features for the spliced rib elements in addition to the bolt and nut assemblies helps the beams 14 retain their high bending moments particularly in the crown areas which are normally the most highly loaded portions of the beam structure and provides further insurance against bending moment continuity of the various beams 14 being lost in a given culvert structure. The design of the splicing crown rib 18 when such rib is used should also be such that it will have a bending moment capacity at least equal to the bending moment capacity of the adjoining haunch ribs 16 in a given beam 14 so as not to impair the overall bending moment continuity of the beam 14 resulting from the use of such ribs.

In a further embodiment of the invention and as indicated particularly in FIG. 2 the smooth walled sections 12 are so oriented during joinder that the lapped edge portion 12*a* of the one section 12 is the lowermost section directly exposed to the material flowing through the culvert and in effect comprises a step facing the exit end of the culvert structure. The amount which the portion 12*a* is overlapped by the lapping edge 12*b* of the adjacent uppermost section 12 is preferably at least equal to the width of the base flange of the haunch rib 16 to minimize distortion of the sheeting 12 under loading and to maximize transfer of concentrated and uniform loads into the beams 14. If desired the base flange 28 of rib 16 can be somewhat smaller in width than that of the crown rib 18. This particular arrangement for overlapping the sections 12 is a feature which also allows for minimal obstruction to the flow of material through the culvert.

Assembly of the culvert 10 is completed and the culvert anchored to the soil 50 by means of suitable elongated concrete footings 36 provided with elongated slots or channels 37. Channels 37 act as receptacles for the terminal ends of the arched sections 12 as well as the terminal ends of the haunch portions of beams 14 and the usual grout 37*a*. In contrast to most shallow arch culverts of the past which utilized corrugated sheeting and outer or inner reinforcing cross ribbing, that terminated short of the footings, the haunch portions of the beams 14 in a preferred embodiment of the invention are deliberately led into and fit in the footings 36 so as to transfer the loads on beams 14 directly into the footings.

Depending upon the installation site and requirements of the user the bottom of the culvert 10 may be fitted with a concrete floor or apron 52 or even a metal floor constructed of flat aluminum sheeting reinforced on the underside by cross ribbing, so as to not impede the flow of material through the culvert. Again, depending upon the individual requirements of a particular site, the culvert 10 may or may not be covered with earth fill and may if desired rely to some extent on the pressure of the surrounding soil for additional reinforcement.

Although the spacing of the beams 14 along a given length of culvert is a matter of choice the spacing preferably should be uniform and for optimum results the base flange of a haunch rib should preferably have a width that approximates 15% of the distance from the centerline of one beam 14 to the centerline of the adjacent beam 14. Finally in order to further minimize surface roughness inside of the culvert and enhance the friction free character of the interior wall of the culvert appropriate round headed bolt elements should be employed in the nut and bolt assemblies 17, all as noted in FIG. 2.

An advantageous embodiment of the invention has been disclosed and described. It is obvious that various changes and modifications may be made therein without departing from the spirit and scope thereof as defined in the appended claims.

We claim:

1. A low headroom hydraulic culvert of the type described comprising the combination of:

(a) a plurality of shallow arch shaped smooth wall sections overlappingly connected at their marginal side edge portions in such a fashion as to present a relatively obstruction-free walled interior to fluids and debris passing therethrough;

(b) means interconnecting adjacent smooth wall sections together to form a unitized structure in which said means serve as the principal load bearing components of the culvert and provide high bending moment continuity across the entire width of the culvert and throughout the culvert;

(c) said interconnecting means comprising exteriorly disposed rotation and torsion resistant arched girder-like beams;

(d) said beams having ground anchored haunch elements provided with base flanges and separate central crown elements provided with tongue and groove means for interlocking said haunch and crown elements together;

(e) the base flange of a given beam haunch element being directly mounted upon the topmost side edge portion of a pair of adjacent and overlapped side edge portions of a given pair of smooth wall sections;

(f) the lapped side edge portion of the one smooth wall section in said pair of overlapped smooth wall sections being the smooth wall section side edge portion in the resulting joint that is directly exposed to the material passing through the culvert and with the free marginal edge of said lapped side edge portion also facing the exit end of the culvert; and (g) common anchor means securing a given beam to each of the smooth wall sections in said pair of overlapped smooth wall sections at the point of overlap and the joint therebetween.

2. The culvert of claim 1 wherein the amount of overlap of the overlapped smooth wall sections in a pair of overlapped sections is substantially equal to the width of the base flange of a haunch portion of a given beam.

3. A low headroom culvert of the type described comprising the combination of:

(a) a plurality of shallow arch shaped smooth wall sections overlappingly connected at their marginal side edge portions in such a fashion as to present a relatively obstruction-free walled interior to fluids and debris passing therethrough;

(b) means interconnecting adjacent smooth wall sections together to form a unitized structure in which said means serve as the principal load bearing components of the culvert and provide high bending moment continuity across the entire width of the culvert and throughout the culvert;

(c) said means comprising exteriorly disposed rotation and torsion resistant arched girder-like beams;

(d) said beams having ground anchored haunch portions provided with base flanges and central crown portions;

(e) the base flange of a given beam haunch portion being directly mounted upon the topmost side edge portion of a pair of adjacent and overlapped side edge portions of a given pair of smooth wall sections;

(f) the lapped side edge portion of the one smooth wall section in said pair of overlapped smooth wall sections being the smooth wall section side edge portion in the resulting joint that is directly exposed to the material passing through the culvert and with the free marginal edge of said lapped side edge portion also facing the exit end of the culvert;

(g) common anchor means securing a given beam to each of the smooth wall sections in said pair of overlapped smooth wall sections at the point of overlap and the joint therebetween; and (h) said haunch and crown portions of a given beam comprising a pair of haunch ribs and a crown rib spliced together in the central arch crown area of the culvert.

4. The culvert of claim 3 wherein said haunch and crown ribs are provided with cooperating tongue and groove means.

5. The culvert of claim 3 wherein the crown rib has a bending moment capacity at least equal to the bending moment capacity of the weakest haunch rib in said pair of haunch ribs.

6. A low headroom hydraulic culvert comprising:

(a) a plurality of shallow arch shaped smooth wall culvert sections overlappingly connected at their side edge portions in such a fashion as to present a relatively obstruction free walled interior to water and debris passing therethrough;

(b) means interconnecting adjacent culvert sections together so as to form a unitized structure said means also serving as the principal load bearing elements in the culvert while providing high bending moment continuity across the width of the culvert and throughout length of the culvert;

(c) said interconnecting means comprising a plurality of exteriorly disposed rotation and torsion resistant arched girder-like beams and at least certain of said beams being secured to adjoining pairs of culvert sections at the points of overlap of such sections;

(d) each girder-like beam being comprised of flanged haunch and crown ribs spliced together at the top of the culvert so as to form a substantially continuous arched beam along and across the full width of the culvert arch;

(e) means including tongue and groove elements interlockingly connecting the crown and haunch ribs of a given beam together; and (f) common means connecting the flanged portions of the haunch ribs of the said given beam to a given pair of adjoining overlapped culvert sections at the point of overlap and joinder of the said given pair of culvert sections whereby said given overlapped pair of culvert sections can carry uniform and concentrated loads into said given beam.

7. The culvert of claim 6 wherein said culvert is provided with footings at each side edge thereof and the bottom terminal ends of the haunch ribs of the given beam are anchored to said footings.

8. The culvert of claim 6 wherein the crown rib of the given beam has a bending moment capacity at least equal to the bending moment capacity of the weakest haunch rib in said given beam.

9. The culvert of claim 6 wherein a haunch rib of the given beam is provided with a base flange directly secured to the underlying pair of overlapped culvert section edges of said given pair of culvert sections and with the amount of overlap of the said pair of culvert section edges being equal to the width of the base flange of said haunch rib.

10. The culvert of claim 9 where the culvert sections are made from aluminum alloy sheets and said haunch and crown ribs are made from aluminum alloy extrusions.

* * * * *